United States Patent [19]

Hambleton

[11] 4,111,350

[45] Sep. 5, 1978

[54] SIX-CELL CONTAINER DIVIDER

[75] Inventor: Thomas P. Hambleton, Kansas City, Mo.

[73] Assignee: International Paper Company, New York, N.Y.

[21] Appl. No.: 834,082

[22] Filed: Sep. 19, 1977

[51] Int. Cl.[2] ..... B65D 5/48; B65D 3/24

[52] U.S. Cl. ..... 229/15; 229/42

[58] Field of Search ..... 229/15, 28, 42

[56] References Cited

U.S. PATENT DOCUMENTS

| | | | |
|---|---|---|---|
| 782,544 | 2/1905 | Carrier | 229/15 UX |
| 3,317,111 | 5/1967 | Black | 229/15 |
| 3,738,561 | 6/1973 | Nederveld | 229/15 |
| 3,921,891 | 11/1975 | Gorham | 229/15 |
| 3,931,924 | 1/1976 | Gardner | 229/42 X |
| 3,963,169 | 6/1976 | Gardner | 229/28 R |
| 4,000,844 | 1/1977 | Weimer | 229/15 |
| 4,030,660 | 6/1977 | Rada et al. | 229/42 |

*Primary Examiner*—Davis T. Moorhead

*Attorney, Agent, or Firm*—Jay S. Cinamon

[57] ABSTRACT

A six-cell divider fabricated from an essentially rectangular unitary blank is provided. The divider comprises a central tongue with integrally attached protruding tabs which forms the central wall of the erected divider, symmetrically disposed pairs of first, second, third and fourth wall panels, and first and second floor panels. The protruding tabs are sandwiched between the opposing faces of the third and fourth wall panels, which are brought together to form single walls. Means for securing the tabs may be provided.

14 Claims, 9 Drawing Figures

SIX-CELL CONTAINER DIVIDER

BACKGROUND OF THE INVENTION

This invention relates to dividers for containers and more particularly to a unique six-cell divider formed from a substantially rectangular one-piece blank of corrugated board.

Dividers have long been used in the corrugated container industry to form cells which separate and cushion the articles being shipped. Many articles are shipped in units of a dozen, or, particularly for larger items, units of a half-dozen, so six-cell dividers are often chosen.

The six-cell dividers known in the prior art typically take one of two forms. The more common of the two is the criss-cross divider assembled from three separate interlocking pieces. This design, however, is expensive to handle and assemble. Its bulk makes it difficult to store and it generally will not hold its shape inside a carton.

One-piece projecting-tab dividers were designed to overcome these disadvantages. The dividers are essentially two- or four-cell dividers with projecting cutouts which define the remaining cells. A divider of this type is described in U.S. Pat. No. 3,982,684. Projecting-tab dividers lack the full-wall shielding necessary to protect breakable or perishable articles. Furthermore, the presence of cutouts depending on their location, greatly reduces the stacking strength of the assembled dividers. Also, the tabs are more likely to bend during the filling operation than would be the case with full walls. There exists a longfelt need in the container industry for a six-cell divider which combines strength and stability with ease of assembly.

SUMMARY OF THE INVENTION

The present invention provides a divider having six full-walled cells. It is assembled from a one-piece, rectangular blank of corrugated board which consists of a central section flanked by a pair of indentical side sections. Each of the side sections contains foldably connected first, third, fourth and second wall panels. The central section contains a first floor panel which foldably connects the two first wall panels, a central tongue which is foldably connected to the first floor panel, and a second floor panel which foldably connects the two second wall panels. The central section may also contain a fingerhole or detachable finger panel which lies in an abutting relation to the second floor panel and the central tongue. The central tongue, which has integrally attached protruding tabs, is detachable from the surrounding blank on every side but one. My divider is assembled by striking the central tongue from the blank and raising it to an upstanding position, bringing the faces of the third wall panels into opposition with the faces of the fourth wall panels, folding the first wall panels outward at an angle of about 90° to the third wall panels, folding the second wall panels outward at an angle of about 90° to the fourth wall panels, and folding each of the side sections inward at an angle of about 90° to the central section. The protruding tabs may be sandwiched between the opposing faces of the third and fourth wall panels, or alternatively, the tabs may be secured to the fourth wall panel.

The full nature of the invention will be understood from the accompanying drawings and the following description and claims. Objects, features, and advantages of the invention will become apparent in the course of the description.

DETAILED DESCRIPTION OF THE INVENTION

Figure 1:
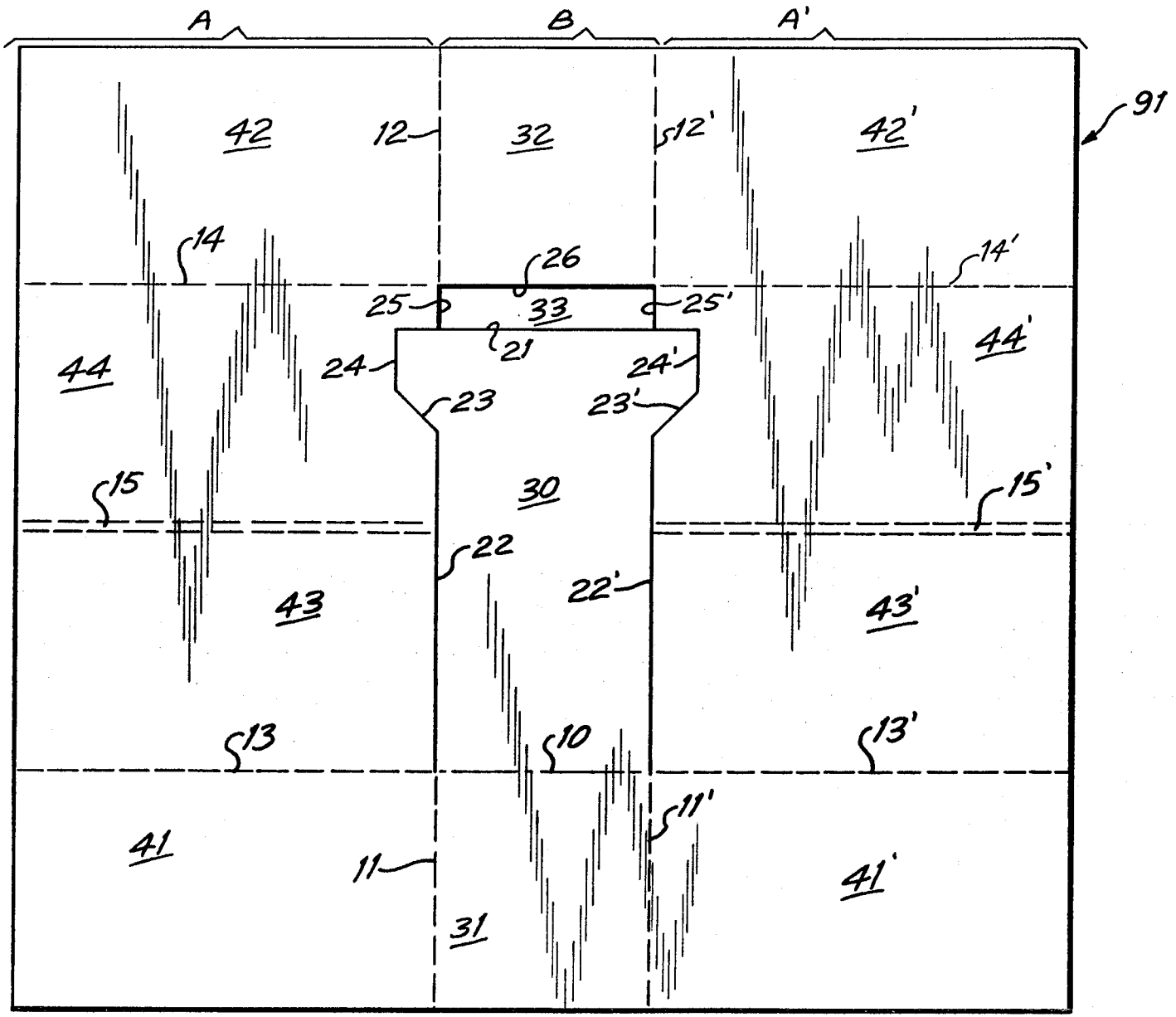
FIG. 1 is a top view of a cut and scored blank from which one embodiment of the invention can be erected.

In FIG. 1 of the drawings, the numeral 91 is used generally to designate the rectangular blank from which one embodiment of the subject invention may be constructed. The blank consists of three vertical sections, namely, two identical side sections, A and A', flanking a central section, B. Each section is horizontally divided by slit and score lines into several panels. The central section, B, consists of a first floor panel, 31, a central tongue 30, a detachable finger panel, 33, and a second floor panel, 32. The central tongue, 30, is foldably connected to the first floor panel, 31, along horizontal score line 10, which is preferably an unperforated score line. The tongue is defined along its remaining edges by slit lines 21, 22, 22', 23, 23', 24 and 24'. The detachable finger panel, 33, which may be removed at any time prior to the erection of the divider, is defined by slit lines 21, 25, 25' and 26. In this embodiment, the second floor panel, 32, is contiguous with the finger panel, 33, along slit line 26.

The central tongue, 30, features a pair of integrally attached protruding tabs. In the preferred embodiment these tabs are located near the top of the tongue and extend laterally, to form a panel which is generally T-shaped. It is within the spirit of the invention, however, to locate the tabs anywhere along the vertical edges of the central tongue.

Side section A is divided by score lines 13, 14 and 15, into a first wall panel, 41, a second wall panel, 42, a third wall panel, 43, and a fourth wall panel, 44. Similarly, side section A' is divided by score lines 13', 14' and 15' into a first wall panel, 41', a second wall panel, 42', a third wall panel, 43', and a fourth wall panel, 44'. The first wall panels, 41 and 41', are foldably connected to the first floor panel, 31, along vertical score lines 11 and 11', respectively. First wall panel 41 is foldably connected to third wall panel 43 along horizontal score line 13, and first wall panel 41' is foldably connected to third wall panel 43' along horizontal score line 13'. The second wall panels, 42 and 42', are foldably connected to the second floor panel, 32, along vertical score lines 12 and 12', respectively. Second wall panel 42 is foldably connected to fourth wall panel 44 along horizontal score line 14, and second wall panel 42' is foldably connected to fourth wall panel 44' along horizontal score line 14'. Score lines 11, 11', 12, 12', 13, 13', 14 and 14' are preferably perforated score lines. Third wall panel 43 is foldably connected to fourth wall panel 44 along horizontal score line 15, and third wall panel 43' is foldably connected to fourth wall panel 44' along horizontal score line 15'. It is preferred that score lines 15 and 15' be perforated double score lines. It should be noted that the width of the third and fourth wall panels, as measured along score line 15 or 15', is substantially equal to the length of the central tongue. In the preferred embodiment, the length of the third and fourth wall panels is substantially equal to the width of the first and second floor panels, which insures that all of the compartments of the erected divider will be equal in size.

Figure 2:
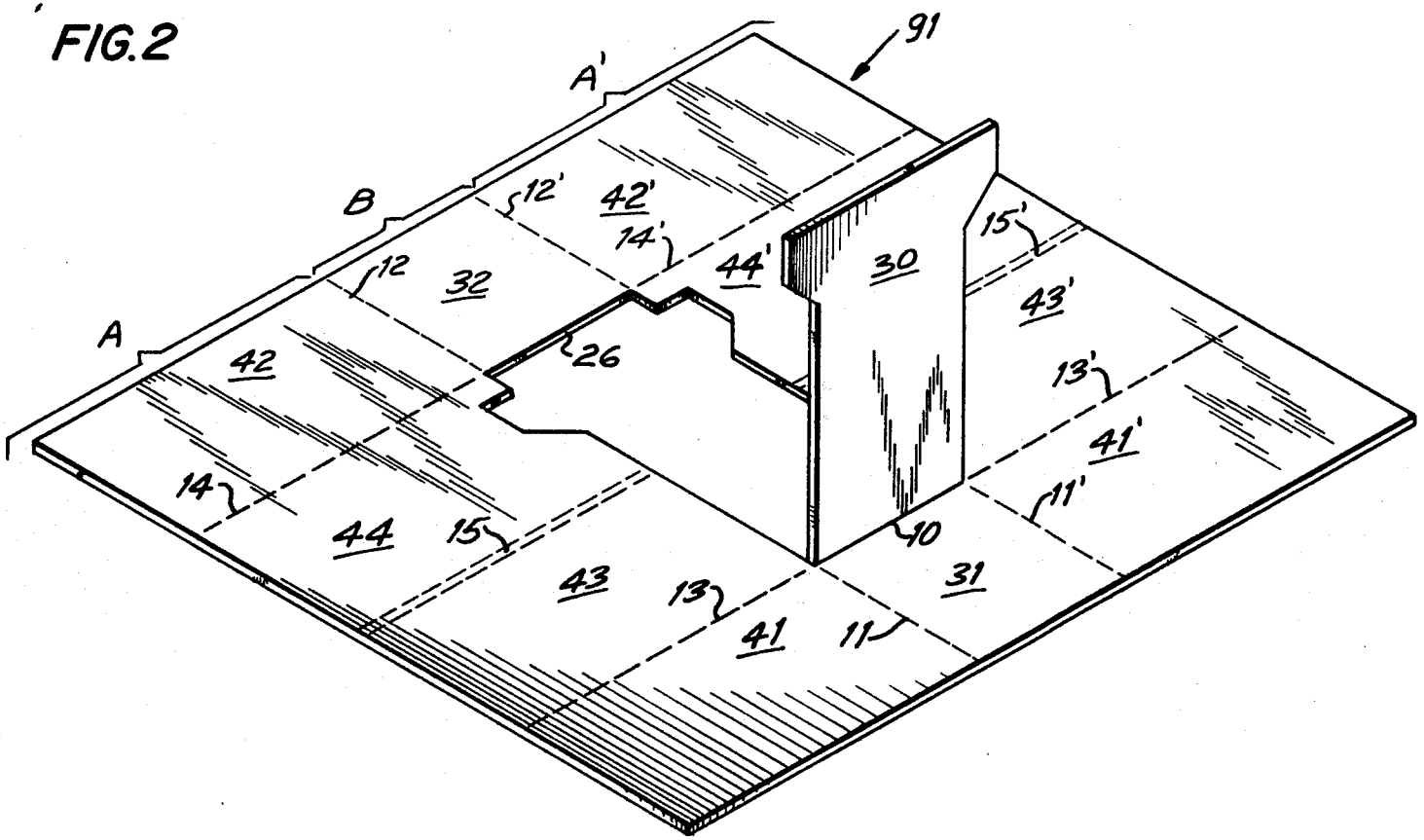
FIG. 2 illustrates the first step in the expanded folding sequence for the subject invention.

Although my divider may be easily assembled from a blank in only two steps, as will be shown later, the novel construction of my invention may best be illustrated by means of the expanded folding sequence shown in FIGS. 2–6. In FIG. 2, the first step in the expanded folding sequence, the detachable finger panel, 33, is removed from the blank. With the assistance of the finger hole thus formed, the central tongue, 30, is struck from the blank and raised to an upstanding position.

Figure 3:
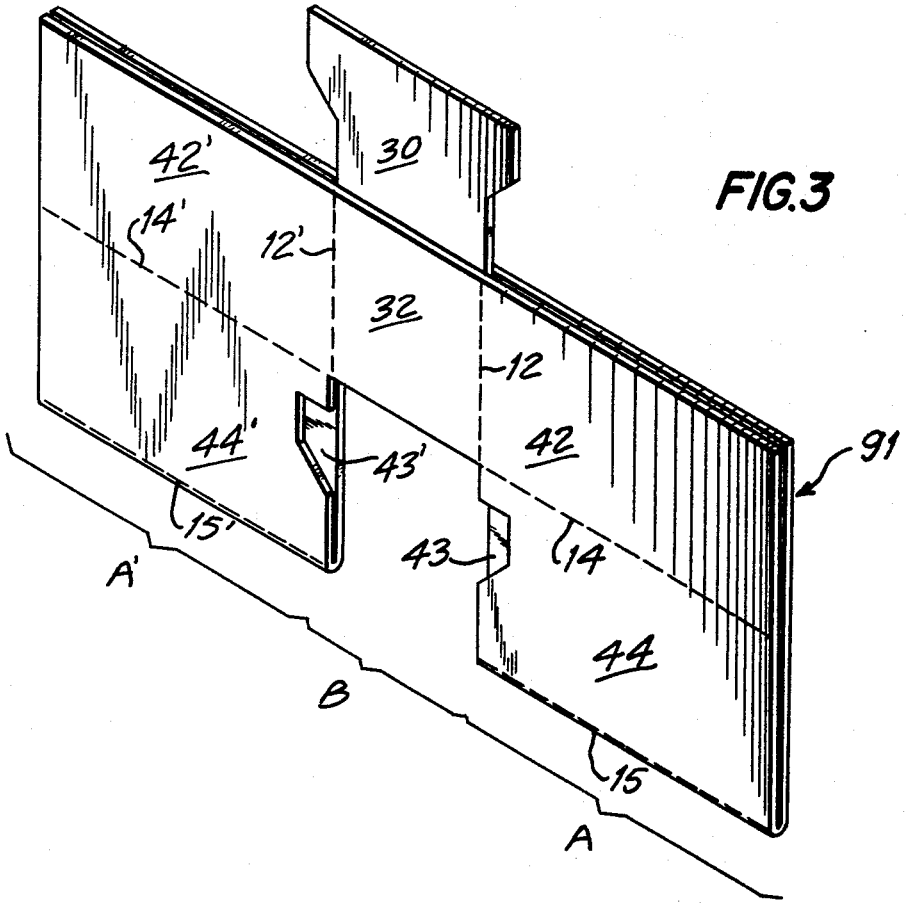
FIG. 3 shows the second step in the expanded folding sequence.

FIG. 3 shows the second step in the expanded folding sequence for the subject invention. The blank, 91, is bent double along score lines 15 and 15', so that the faces of the first and third wall panels are brought into opposition with the faces of the second and fourth wall panels. The central tongue, 30, is sandwiched between the faces of the first floor panel, 31, and the second floor panel, 32.

Figure 4:
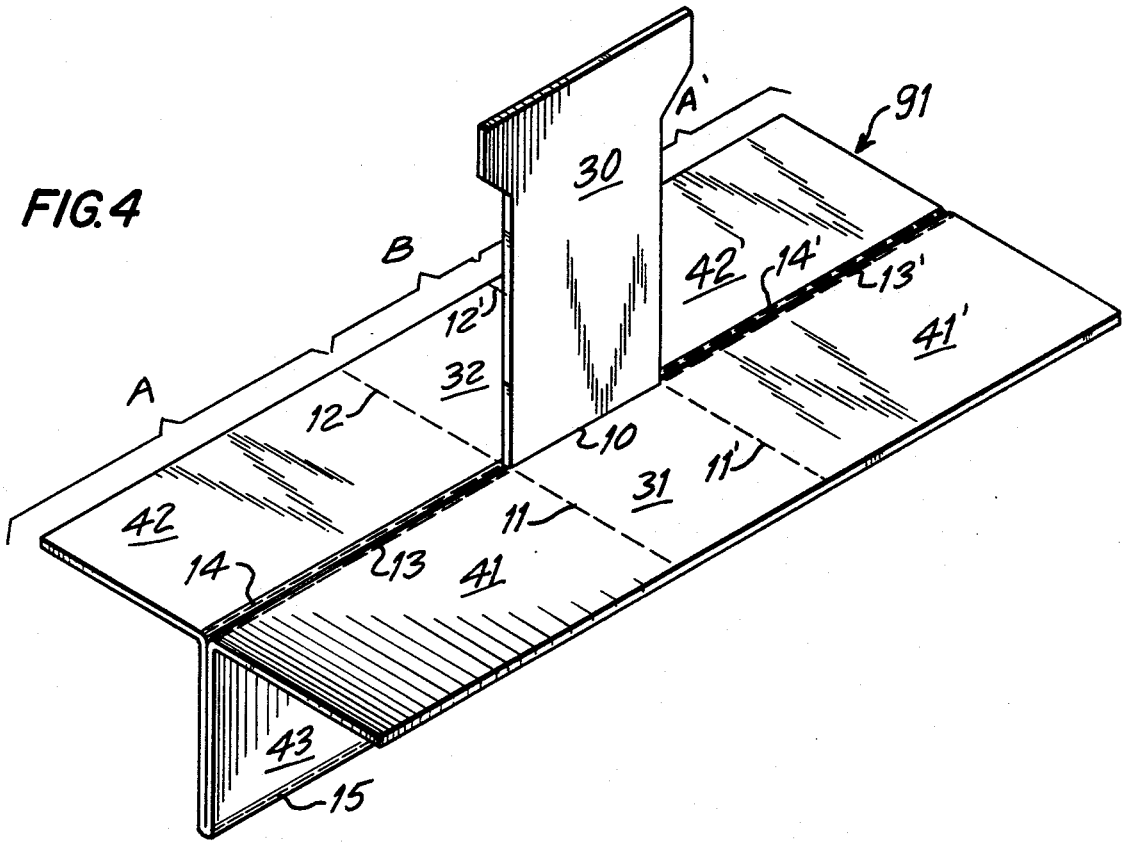
FIG. 4 illustrates the third step in the expanded folding sequence.

The third step in the expanded folding sequence is illustrated in FIG. 4. The first wall panels, 41 and 41', and the first floor panel, 31, are folded outward at an angle of about 90° to the third wall panels, 43 and 43', along score lines 10, 13 and 13'. At the same time, the second floor panel, 32, and the second wall panels, 42 and 42', are folded outward at an angle of about 90° to the fourth wall panels, 44 and 44', along score lines 14 and 14'. The central tongue, 30, remains in an upstanding position. Thus, when the third folding step is completed, the blank is folded into a crosslike shape, with the third and fourth wall panels lying in the same plane as the central tongue and the first and second wall panels essentially perpendicular to them.

Figure 5:
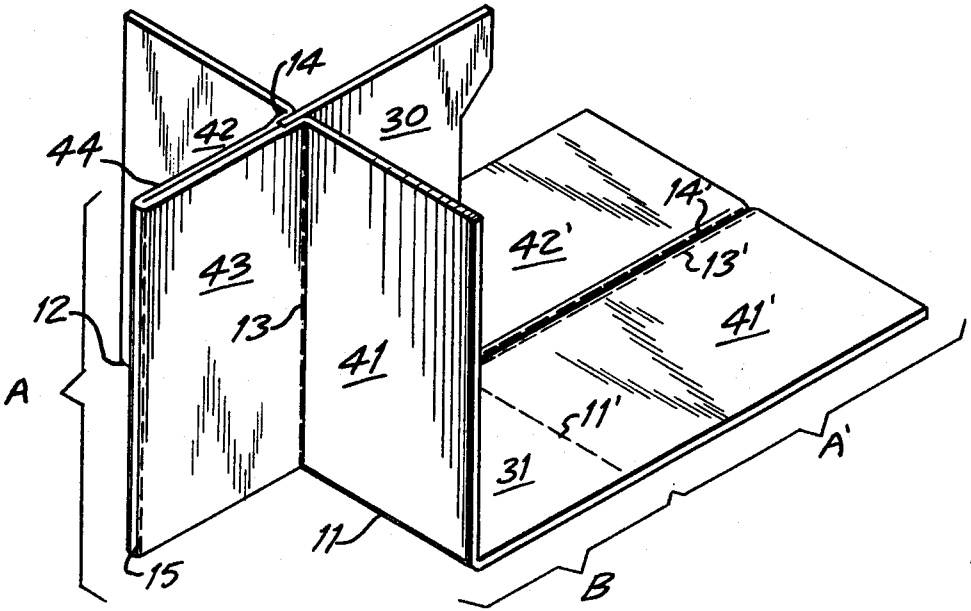
FIG. 5 shows the fourth step in the expanded folding sequence.

In the fourth step in the expanded folding sequence, shown in FIG. 5, side section A is folded inward at an angle of about 90° along score lines 11 and 12. One of the protruding tabs on the central tongue is sandwiched between the opposing faces of third wall panel 43 and fourth wall panel 44.

Figure 6:
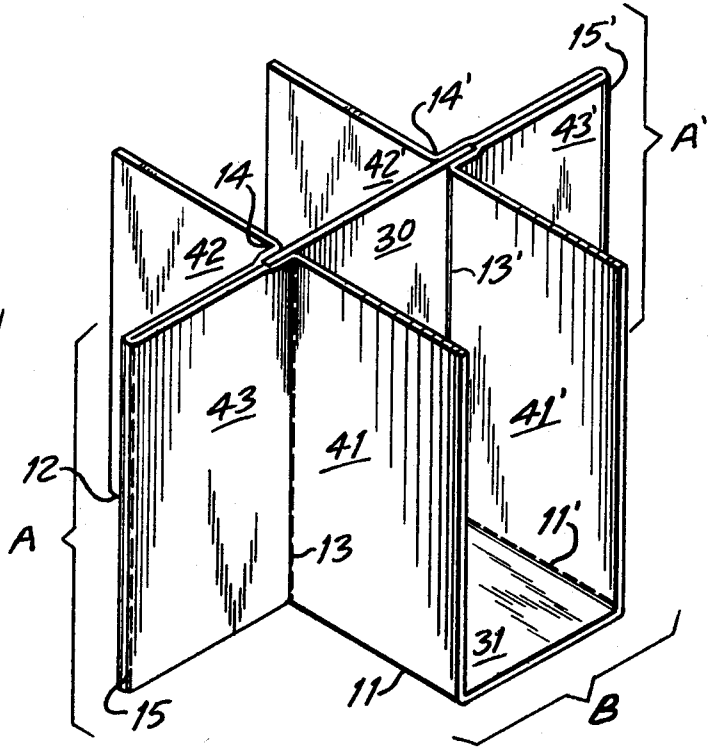
FIG. 6 is a perspective view of the assembled divider which is one embodiment of my invention.

FIG. 6 is a perspective view of the completed divider. In the final step in the folding sequence, side section A' is folded inward at an angle of about 90 along score lines 11' and 12' so that the second tab is sandwiched between the opposing faces of third wall panel 43' and fourth wall panel 44'. The first and second floor panels, 31 and 32, become the floor of the two central divider cells.

The divider of my invention will hold its shape when placed inside a shipping container. This feature makes is suitable for use with automatic packing machines, since each cell will retain a uniform size and shape even if the container/divider combination is handled and jostled before being filled.

Figure 7:
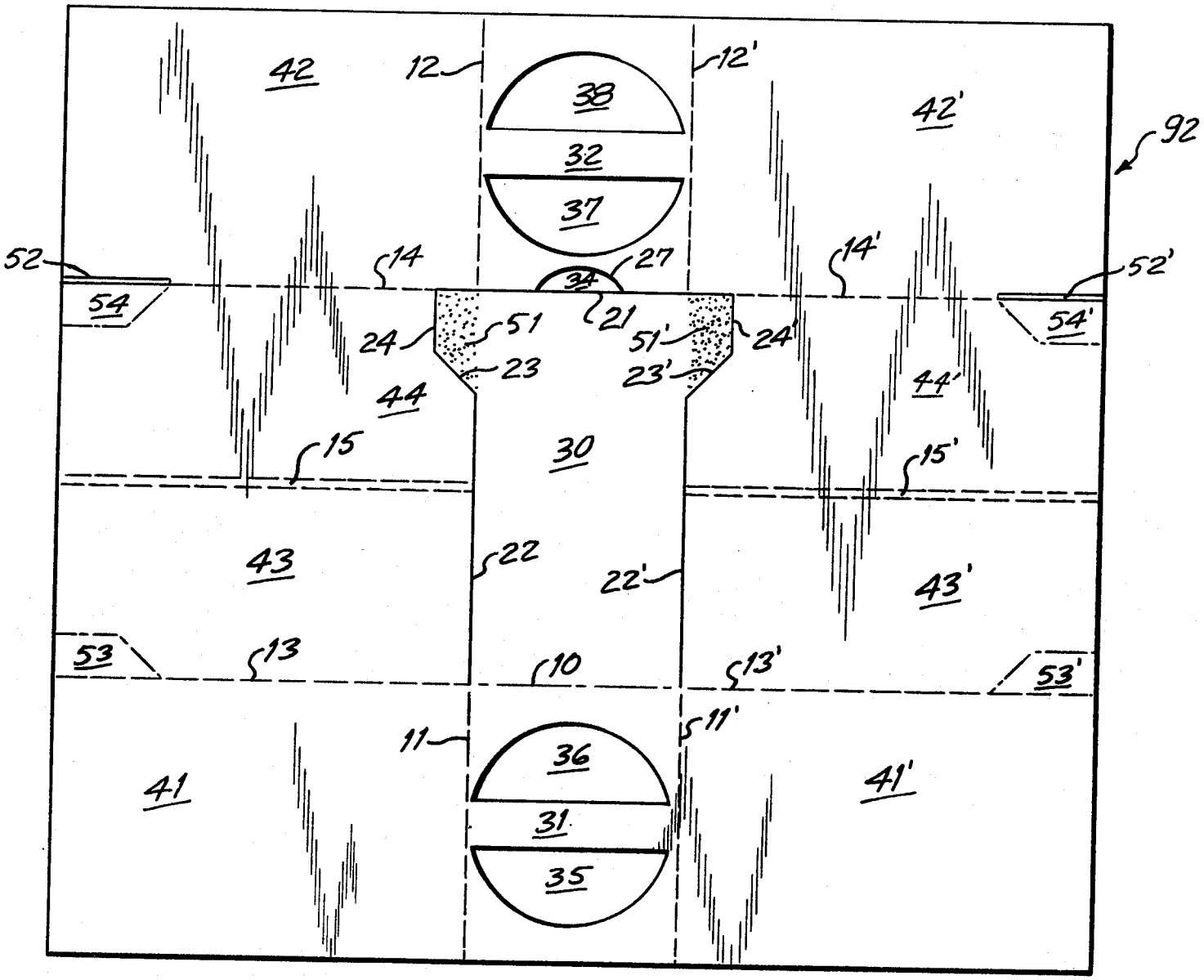
FIG. 7 is a top view of a blank from which a second embodiment of the invention may be erected, illustrating several means for securing the erected divider.

The assembled divider will also hold its shape when standing along if a means for securing the tabs in place is provided. Means for securing the tabs to the fourth wall panels are sufficient; however, it is preferred that means for securing the tabs to the third wall panels be provided as well. Several examples of securing means are shown in FIG. 7, which is a top view of blank 92 from which a second embodiment of my invention may be constructed. Preferably, a contact adhesive is applied to both tabs, on only one surface thereof, in the areas designated as 51 and 51' in FIG. 7. Alternatively, the protruding tabs may be fitted into slots 52 and 52', which lie in an abutting relation to said fourth wall panels and to said second wall panels, to form a lock. The blank may also be coated with an adhesive in the areas designated as 54 and 54', and, if a firmer seal is desired, in the areas designated as 53 and 53' as well. Another alternative, which would result in the firmest seal, would be to apply adhesive to the entire surface of panels 43, 44, 43' and 44'. Other securing means will be obvious to one skilled in the art. The blank shown in FIG. 7 illustrates a number of the variations which can be made in my divider without affecting the spirit of the invention. Although blanks 91 and 92 differ in several respects, wherever possible the same numbering system has been used on both, since, in general, the elements have identical functions.

In addition to the locking means previously discussed, the blank 92, contains several cutouts, 35, 36, 37 and 38, in the first and second floor panels. These cutouts, which may take any desired shape, are provided so that the articles packed in the two center cells will sit at the same level as the others and not require additional headroom. If sufficiently large cutouts are provided, my divider may be loaded from either end, an advantage where automatic packing machines are used. The second floor panel, 32, also contains a finger hole, 34, which, like the detachable finger panel, 33, shown on blank 91, facilitates the striking of the central tongue, 30. However, my invention may also be constructed without the aid of a finger hole or finger panel. It should be noted that in the embodiment illustrated by blank 92, the central tongue, 30, lies in an abutting relationship with the second floor panel, 32, along slit line 21.

Figure 8:
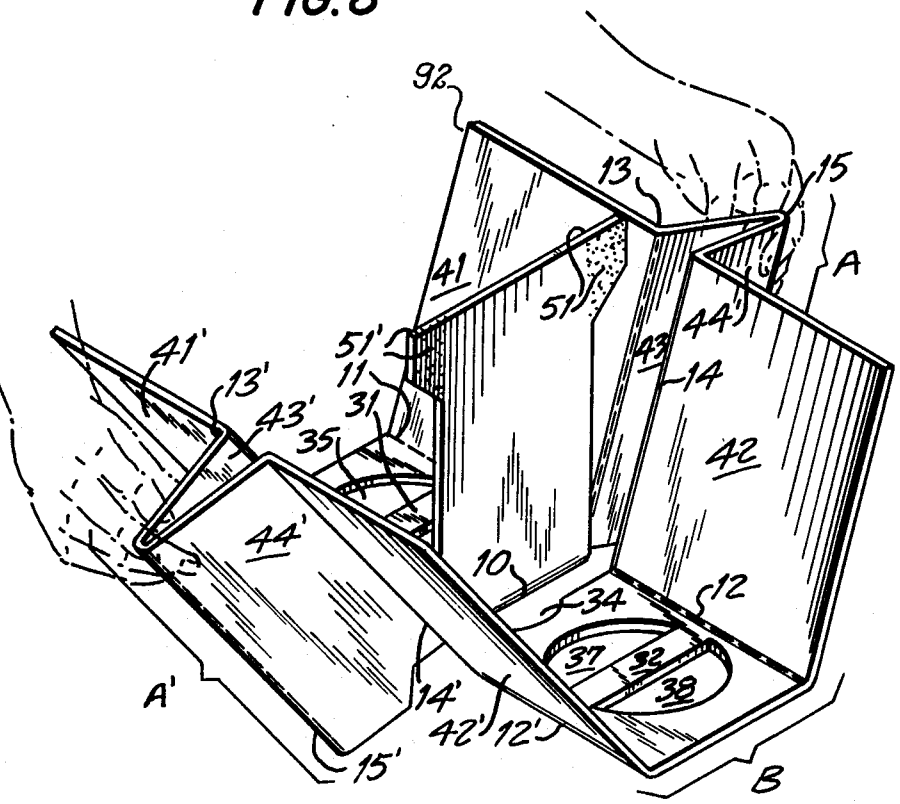
FIG. 8 illustrates the manual folding sequence for the subject invention.

The divider of my invention can be assembled by hand from a flat blank in only two steps. This efficient sequence is a distinct advantage over the cumbersome procedures required for assembling multi-piece interlocking dividers. In the first of the two steps, the central tongue, 30, is struck from the blank and raised to an upright position, just as was shown in FIG. 2. The second step, illustrated in FIG. 8, combines the four steps of the expanded folding sequence shown in FIGS. 3–6. Adjacent third and fourth wall panels are pinched together while each of the two side sections is simultaneously folded upward. Each of the protruding tabs is sandwiched between a third and a fourth wall panel and held there by a securing means. The adhesive coated areas, 51 and 51', are the preferred securing means.

Figure 9:
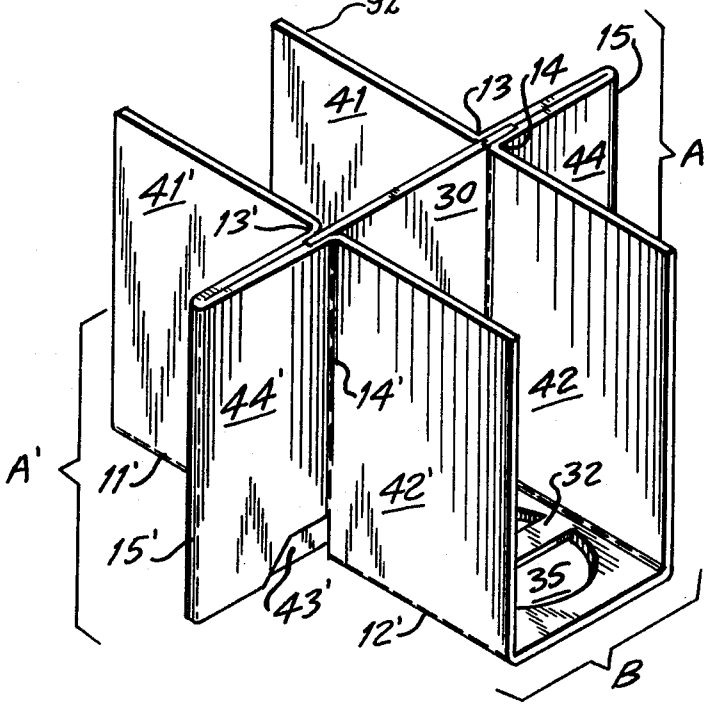
FIG. 9 is a perspective view of a second fully assembled divider.

The assembled divider, shown in FIG. 9, has six full-walled cells, since all of the required cutouts are made in the floor panels or in the double walls formed by the third and fourth wall panels. This feature provides superior stacking strength and increased shielding for the articles being shipped. My invention is designed to hold its shape and resist crushing during handling. It is therefore especially suitable for shipping articles such as plastic and glass bottles. The divider blanks may be stored flat and assembled quickly and easily.

The terms and expressions that have been employed herein are used as terms of description and not of limitation, and there is no intention in the use of such terms and expressions to exclude any equivalents of the features shown and described or portions thereof, but it is recognized that various adaptations are possible within the scope of the invention as claimed.

What is claimed is:

1. A substantially rectangular blank for a six-celled divider, said blank comprising, in combination:

(a) a central tongue having integrally attached and laterally extending protruding tabs at the top of said tongue to form a T-shaped tongue;

(b) said central tongue being foldably connected only to a first floor panel along a horizontal score line;

(c) a pair of first wall panels flanking and foldably connected to said first floor panel;

(d) a third wall panel foldably connected to each of said first wall panels;

(e) a fourth wall panel foldably connected to each of said third wall panels;

(f) a second wall panel foldably connected to each of said fourth wall panels;

(g) a second floor panel foldably connecting said second wall panels;

(h) said third and fourth wall panels lying in an abutting relation to said central tongue, said central tongue being slit from said third and fourth wall panels whereby the tongue can swing about said horizontal score line to an upstanding position upon assembly; and (i) the width of each of said third and fourth wall panels being substantially equal to the length of said central tongue.

2. A blank according to claim 1 further comprising means for securing said protruding tabs to at least one of said third and fourth wall panels.

3. A blank according to claim 1 wherein the length of each of said third and fourth wall panels is substantially equal to the width of said first and second floor panels, whereby a divider having six equal-sized compartments may be formed.

4. A blank according to claim 1 further comprising a detachable finger panel lying in an abutting relation to said second floor panel and to said central tongue.

5. A blank according to claim 1 further comprising cutouts in said first and second floor panels.

6. A six-celled divider formed from a substantially rectangular blank and comprising, in combination:

a central section flanked by a pair of identical side sections;

each of said side sections comprising foldably connected first, third, fourth and second wall panels;

said central section comprising a first floor panel foldably connecting said first wall panels, a single-ply thickness central tongue foldably connected only to said first floor panel, and a second floor panel foldably connecting said second wall panels;

said central tongue having integrally attached and laterally extending protruding tabs at the top of said tongue to form a T-shaped tongue;

the width of each of said third and fourth wall panels being substantially equal to the length of said central tongue;

said central tongue being raised to an upstanding position by folding along a horizontal score line connecting said central tongue to said first floor panel;

the faces of said third wall panels being brought into opposition with the faces of said fourth wall panels;

said first wall panels being folded outward at an angle of about 90° to said third wall panels;

said second wall panels being folded outward at an angle of about 90° to said fourth wall panels;

each of said side sections being folded inward at an angle of about 90° to said central section; and said protruding tabs being sandwiched between the opposing faces of said third and fourth wall panels.

7. A divider according to claim 6 further comprising a detachable finger panel lying in an abutting relation to said second floor panel and to said central tongue.

8. A divider according to claim 6 wherein the length of each of said third and fourth wall panels is substantially equal to the width of said first and second floor panels, whereby a divider having six equal-sized compartments may be formed.

9. A divider according to claim 6 further comprising means for securing said tabs to said third and fourth wall panels.

10. A divider according to claim 9 wherein said securing means are adhesive means.

11. A divider according to claim 6 further comprising cutouts in said first and second floor panels.

12. A six-celled divider formed from a substantially rectangular blank and comprising, in combination:

a central section flanked by a pair of identical side sections;

each of said side sections comprising foldably connected first, third, fourth and second wall panels;

said central section comprising a first floor panel foldably connecting said first wall panels, a single-ply thickness central tongue foldably connected only to said first floor panel, and a second floor panel foldably connecting said second wall panels;

said central tongue having integrally attached and laterally extending protruding tabs at the top of said tongue to form a T-shaped tongue;

the width of each of said third and fourth wall panels being substantially equal to the length of said central tongue;

said central tongue being raised to an upstanding position by folding along a horizontal score line connecting said central tongue to said first floor panel;

the faces of said third wall panels being brought into opposition with the faces of said fourth wall panels;

said first wall panels being folded outward at an angle of about 90° to said third wall panels;

said second wall panels being folded outward at an angle of about 90° to said fourth wall panels;

each of said side sections being folded inward at an angle of about 90° to said central section; and said protruding tabs being secured to at least one of said third and fourth wall panels.

13. A divider according to claim 12 wherein said protruding tabs are secured by means of slots lying in an abutting relation to said fourth wall panels and to said second wall panels.

14. A divider according to claim 12 further comprising a detachable finger panel lying in an abutting relation to said second floor panel and to said central tongue.

* * * * *